United States Patent [19]

McLaughlin, deceased et al.

[11] 4,249,322

[45] Feb. 10, 1981

[54] SNOWPLOW

[76] Inventors: Charles S. McLaughlin, deceased, late of Harwichport, Mass.; Charles S. McLaughlin, Jr., executor, Three Fiddlers Landing, Harwichport, Mass. 02646

[21] Appl. No.: 50,666

[22] Filed: Jun. 21, 1979

[51] Int. Cl.[3] ..... E01H 5/00

[52] U.S. Cl. ..... 37/41

[58] Field of Search ..... 37/14, 19, 41, 42 R, 37/43, 12

[56] References Cited

U.S. PATENT DOCUMENTS

| | | | |
|---|---|---|---|
| 178,172 | 5/1876 | Mabbs | 37/19 |
| 288,903 | 11/1883 | Willey | 37/19 |
| 842,461 | 1/1907 | Hill | 37/19 X |
| 947,121 | 1/1910 | McLain | 37/19 |
| 1,406,993 | 2/1922 | McConley | 37/41 |
| 1,570,806 | 1/1926 | Walling | 37/41 |
| 1,621,448 | 3/1927 | Zilbersher | 37/41 X |
| 2,078,310 | 4/1937 | Berres | 37/19 X |
| 2,109,094 | 2/1938 | Smeal | 37/19 X |
| 2,802,286 | 8/1957 | Wylie | 37/14 X |
| 3,395,467 | 8/1968 | Allen et al. | 37/41 X |

FOREIGN PATENT DOCUMENTS

| | | | |
|---|---|---|---|
| 54645 | 4/1938 | Denmark | 37/19 |
| 387707 | 1/1924 | Fed. Rep. of Germany | 37/14 |

*Primary Examiner*—E. H. Eickholt

[57] ABSTRACT

A vehicle-mounted snowplow having a scoop with a large intake opening for receiving snow and air, which scoop tapers to a narrow throat connected to an outlet means whereby the speed of the air through the scoop is increased as the scoop narrows so that the air carries the scooped snow through the outlet means and discharges it from the outlet means at a high velocity.

2 Claims, 3 Drawing Figures

FIG 1
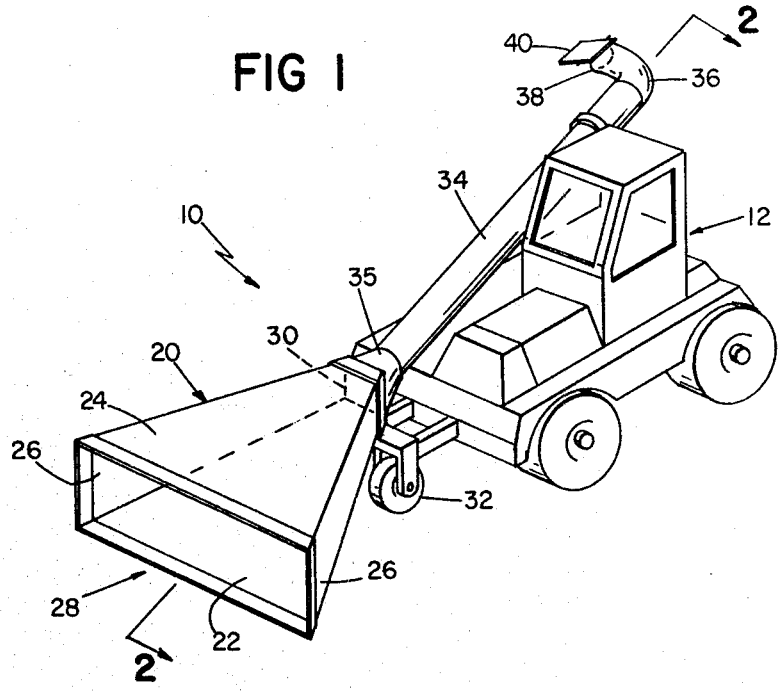
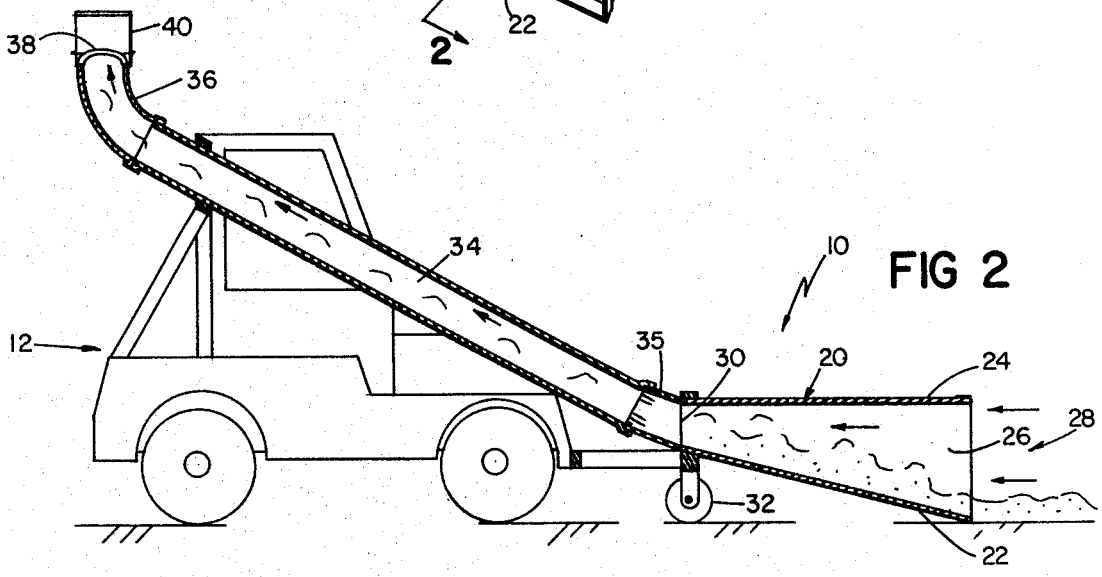
FIG 2
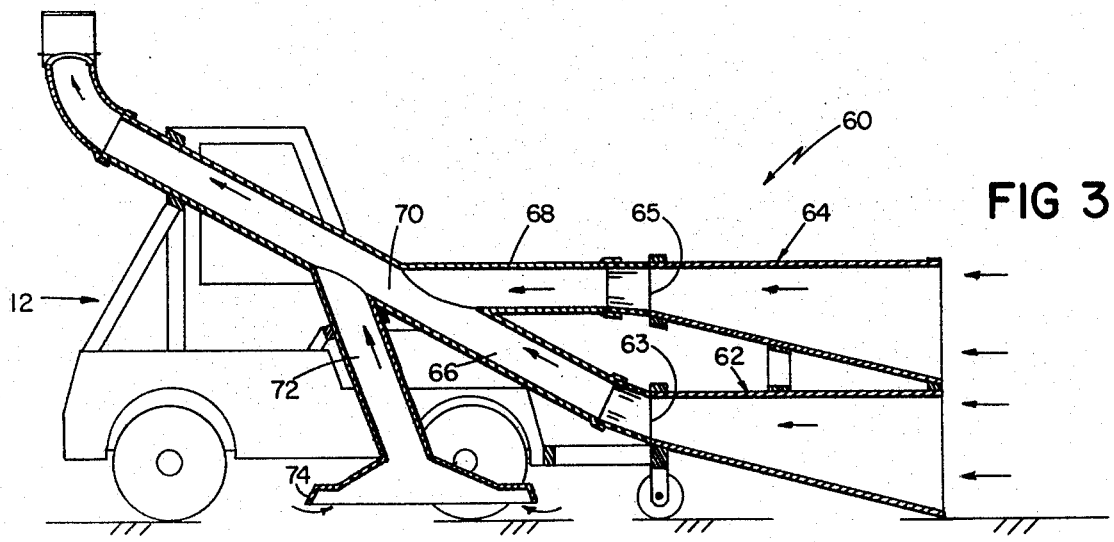
FIG 3

SNOWPLOW

FIELD OF THE INVENTION

This invention relates to snow removal equipment, and more particularly to vehicle-mounted snowplows.

BACKGROUND OF THE INVENTION

In snow removal, blade-type snowplows are attached to the front of trucks or other vehicles, and fallen snow on a surface, i.e. a street or airport runway, is pushed to one side by the snowplow as the vehicle moves forward. These prior art snowplows, however, have several drawbacks. The plowed snow is piled up at the side of the cleared area, and the resulting snow pile blocks any driveways, streets or other travel surfaces which the plowing vehicle passes. Continuous plowing adds to the width of these piles, which decreases the width of the plowed area to some extent. Further, the snowplow compresses the snow as it moves forward thereby increasing the per volume weight of the snow and subjecting the plowing vehicle to considerable strain.

Berres U.S. Pat. No. 2,078,310 shows a snow-removing attachment for a truck with a snowplow. The attachment receives the plowed snow, and an engine-driven blower creates an air flow which forces the snow out of a conduit and away from the side of the truck. Wylie U.S. Pat. No. 2,802,286 shows a snowplow in which compressed air is used to aerate the swept-up snow and aid in carrying it away. Both these devices, however, require additional power sources for the air blowing operations.

SUMMARY OF THE INVENTION

I have discovered that a vehicle-mounted snowplow can be made in the form of a large tapered scoop which, as the vehicle moves forward, ingests air and surface snow while creating a wind tunnel effect to discharge the scooped snow at high velocity up into the air or off to a side so that the discharged snow falls well beyond the surface being cleared.

In a preferred embodiment a snowplow comprises a scoop having a large intake opening, tapered walls and a small rear throat. The scoop is mounted on the front of a vehicle with the intake opening positioned to receive air and surface snow as the vehicle moves forward. The throat communicates with a narrow discharge pipe which is inclined from the scoop to the upper rear of the vehicle. The discharge pipe has a variable-direction outlet section on its end opposite the throat, and a deflector plate is hinged at an opening of this outlet section.

In another preferred embodiment two separate scoops are used. Narrow discharge pipes from the throats of both scoops meet at a junction. One end of a suction tube also communicates with the junction. The other end of the suction tube is disposed behind the scoops just above the surface being cleaned.

The invention permits snow to be removed from a surface and discharged at a high velocity so that it travels away from the vehicle and the surface being cleared. As the cross-sectional area of the scoop decreases as the scoop tapers to the throat, the speed of air ingested by the scoop increases proportionally. This rapidly-flowing air carries the scooped snow through the pipe at a high velocity, and it is ejected from the opening of the outlet section. Because of the high velocity of the ejected snow, it will travel a considerable distance from this opening. The position of the outlet section and the deflector plate control the direction of the ejected snow. In the other preferred embodiment, the second scoop increases the amount of high-speed air in the pipe. The speed of the snow and air mixture through the junction pulls additional snow up through the suction tube.

PREFERRED EMBODIMENTS

I turn now to a description of the structure and operation of the preferred embodiments of the invention, after first briefly describing the drawings.

DRAWINGS

FIG. 1 is a perspective view of the snowplow of this invention;

FIG. 2 is an enlarged cross-sectional view taken along lines 2—2 of FIG. 1;

FIG. 3 is an enlarged cross-sectional view of another snowplow of this invention.

STRUCTURE

In the most preferred embodiment, as shown in FIGS. 1 and 2, snowplow apparatus 10 is mounted on vehicle 12. Snowplow apparatus 10 generally comprises an air and snow scoop 20, a discharge pipe 34, and an outlet section 36.

Scoop 20 has a floor 22 and a top 24 separated by tapered sidewalls 26. Floor 22 and top 24 are generally trapezoidal with their longest sides defining with sidewalls 26 a large intake opening 28. A small open throat 30 is disposed at the end of the scoop 20 opposite large intake opening 28. Floor 22 is inclined upwardly from the intake opening 28 to the throat 30. Front portion of floor 22 is adjacent to the road surface. Wheel 32 supports the scoop 20 below the throat 30. Large intake opening 28 is approximately 8′×2′, while throat 30 is almost square with sides of about 1′ in length. The scoop 20 is made of metal or strong plastic.

Discharge pipe 34 also has a diameter of about 1′ and is attached to the throat 30 of scoop 20 by connector 35. Pipe 34 is inclined and extends rearwardly to the upper part of the back of vehicle 12. Movable outlet section is flexible, and the end of outlet section 36 with opening 38 can rotate approximately 180° about both a vertical axis and a horizontal one. A deflector plate 40 is hinged to the side of outlet section 36 at opening 28.

OPERATION

In operation, vehicle 12 is driven forward, and snow lying on a surface is taken into the scoop 20 through the large intake opening 28. As the vehicle continues to move forward, the scooped snow moves up the inclined floor 22 of the scoop 20 towards the throat 30. This snow meets only some sidewall resistance as it passes through the scoop and only begins to compress as it nears throat 30. During this time, a large quantity of air also enters scoop 20 through intake opening 28. As the cross-sectional area of the scoop 20 decreases towards the throat 30, the speed of this air increases proportionally. Air entering the scoop at 30 mph may reach a speed of 90 mph at the throat. The inclined floor 22 directs the scooped snow up into the path of this high velocity airflow near the throat 30. The snow becomes somewhat aerated, and the air and snow mix proceeds up through pipe 34 into outlet section 36 where it exits through outlet opening 38 at a high velocity. The direction of this exiting flow depends upon the position of the outlet section 36. The vehicle operator may use hydraulic controls (not shown) to change this position as desired. Deflector plate 40, which is also connected to the hydraulic controls, can be used to temporarily deflect the exiting snow when it appears that it would land on areas which should be kept clear, i.e. driveways or other streets. The speed of the exiting snow is sufficient to carry the snow well away from the vehicle and the cleared surface. Outlet section 36 can also be directed to discharge the snow upward. Due to the speed of the exiting snow, it travels sufficiently high enough so that the winds of the storm can carry it away from the cleared area.

Other Embodiments

In another preferred embodiment shown in FIG. 3, snowplow apparatus 60 has a lower scoop 62 and an upper scoop 64. Scoops 62, 64 are similar to the scoop of the previous embodiment. Throat 63 of scoop 62 is connected to a discharge pipe 66. Throat 65 of scoop 64 is connected to another discharge pipe 68. Discharge pipes 66, 68 are connected internally at junction 70. Suction tube 72 also enters junction 70. Suction tube 72 extends from junction 70 downward towards a flange 74 which is adjacent to the road surface. As the snowplow apparatus 60 moves forward, snow and air pass through lower scoop 62 as before. Additional air passes through upper scoop 64. The high velocity of the additional air from scoop 64 with the aerated snow from scoop 62 produces a greater wind tunnel effect. It also creates a suction through tube 72. This suction acts to pick up loose snow missed by lower scoop 62. Of course, it is possible to use this double scoop embodiment without the suction tube 72. The suction tube may also be used with the upper scoop alone. In this case, surface snow is not picked up by the scoop, but instead is picked up entirely by the suction tube.

Other embodiments will occur to those skilled in the art.

What is claimed is:

1. A vehicle-mounted snowplow comprising:

a scoop, said scoop defining an intake opening at one end and being tapered so as to define a smaller throat opening at the other end, an outlet means connected to said throat opening, and a suction tube connected to said outlet means, said suction tube defining a suction tube opening at its end opposite said outlet means, whereby air ingested by said intake opening of said scoop as said scoop moves forward, increases in speed through said outlet means so that said suction tube picks up surface snow through said suction tube opening.

2. A vehicle-mounted snowplow comprising:

a first scoop, said first scoop defining an intake opening at one end and being tapered so as to define a smaller throat opening at the other end, an outlet means connected to said throat opening, a second scoop positioned above said first scoop, said second scoop communicating with said outlet means at a junction, and a suction tube, said suction tube being connected at one end to said junction, the other end of said suction tube being positioned at the same level as the floor of said first scoop at said intake opening, whereby air and surface snow are ingested by said intake opening of said first scoop as said first scoop moves forward, the speed of the air increasing to a high velocity as the scoop narrows to said throat so that the high velocity air carries the snow through said outlet means and out of and away from said outlet means at a high velocity.

* * * * *